United States Patent [19]

Zakiewicz

[11] 4,305,463

[45] Dec. 15, 1981

[54] OIL RECOVERY METHOD AND APPARATUS

[75] Inventor: Bohdan Zakiewicz, Houston, Tex.

[73] Assignee: Oil Trieval Corporation, Irving, Tex.

[21] Appl. No.: 89,871

[22] Filed: Oct. 31, 1970

[51] Int. Cl.[3] ..... E21B 43/30; E21B 43/263; E21B 33/138

[52] U.S. Cl. ..... 106/245; 166/52; 166/75 R; 166/249; 166/263; 166/266; 166/281; 166/299

[58] Field of Search ..... 166/52, 53, 64, 75 R, 166/245, 249, 258, 259, 261, 263, 266, 267, 268, 271, 272, 274, 281, 283, 288, 299, 303, 306, 308

[56] References Cited

U.S. PATENT DOCUMENTS

| | | | |
|---|---|---|---|
| 1,198,078 | 9/1916 | Squires | 166/245 X |
| 1,249,232 | 12/1917 | Squires | 166/272 X |
| 2,584,605 | 2/1952 | Merriam et al. | 166/272 X |
| 2,642,943 | 6/1953 | Smith et al. | 166/261 |
| 2,823,752 | 2/1958 | Walter | 166/272 |
| 3,260,308 | 7/1966 | Cryer | 166/64 X |
| 3,273,640 | 9/1966 | Huntington | 166/271 X |
| 3,302,707 | 2/1967 | Slusser et al. | 166/263 X |
| 3,332,488 | 7/1967 | Wilson | 166/259 X |
| 3,346,044 | 10/1967 | Slusser | 166/259 X |
| 3,349,843 | 10/1967 | Huitt | 166/281 X |
| 3,361,201 | 1/1968 | Howard | 166/271 X |
| 3,380,522 | 4/1968 | Payne, Jr. et al. | 166/268 |
| 3,525,398 | 8/1970 | Fisher | 166/308 X |
| 3,637,013 | 1/1972 | Jones | 166/281 X |
| 3,640,344 | 2/1972 | Brandon | 166/249 |
| 3,688,507 | 9/1972 | Muller | 166/281 X |
| 3,977,469 | 8/1976 | Broussard et al. | 166/267 X |
| 3,990,512 | 11/1976 | Kuris | 166/249 |
| 4,019,578 | 4/1977 | Terry et al. | 166/267 |
| 4,102,397 | 7/1978 | Terry | 166/259 |

*Primary Examiner*—James A. Leppink
*Assistant Examiner*—George A. Suchfield
*Attorney, Agent, or Firm*—Kanz & Timmons

[57] ABSTRACT

Disclosed are systems for removing hydrocarbons from subterranean deposits thereof. A fluid-impervious barrier screen is formed to isolate parts of the deposit or to isolate the deposit from adjacent fluid-permeable earth formations. The barrier screens are formed by fracturing a vertical zone in the formation by micropercussive fracturing or detonation of microexplosive charges in a series of closely-spaced bore-holes to form a vertically extending fractured plane. The fractured plane is sealed with a sealing medium to form a fluid-impervious screen.

Hydrocarbons trapped in the enclosed deposit zone are flushed from the formation by recirculating a fluid medium such as superheated brine and/or hot gases through the enclosed deposit zone under sufficient pressure to cause turbulent flow through the pore formations and to relieve the overburden pressure. The flushing medium may be injected in a series of pressure pulses to force the fluid through the pores by hydraulic ramming.

In situ gassification is also performed in subterranean deposits isolated by the barrier screens to form gas products for exploiting liquid reserves and to remove immobile reserves as a gas product.

26 Claims, 2 Drawing Figures

OIL RECOVERY METHOD AND APPARATUS

Figure 1:
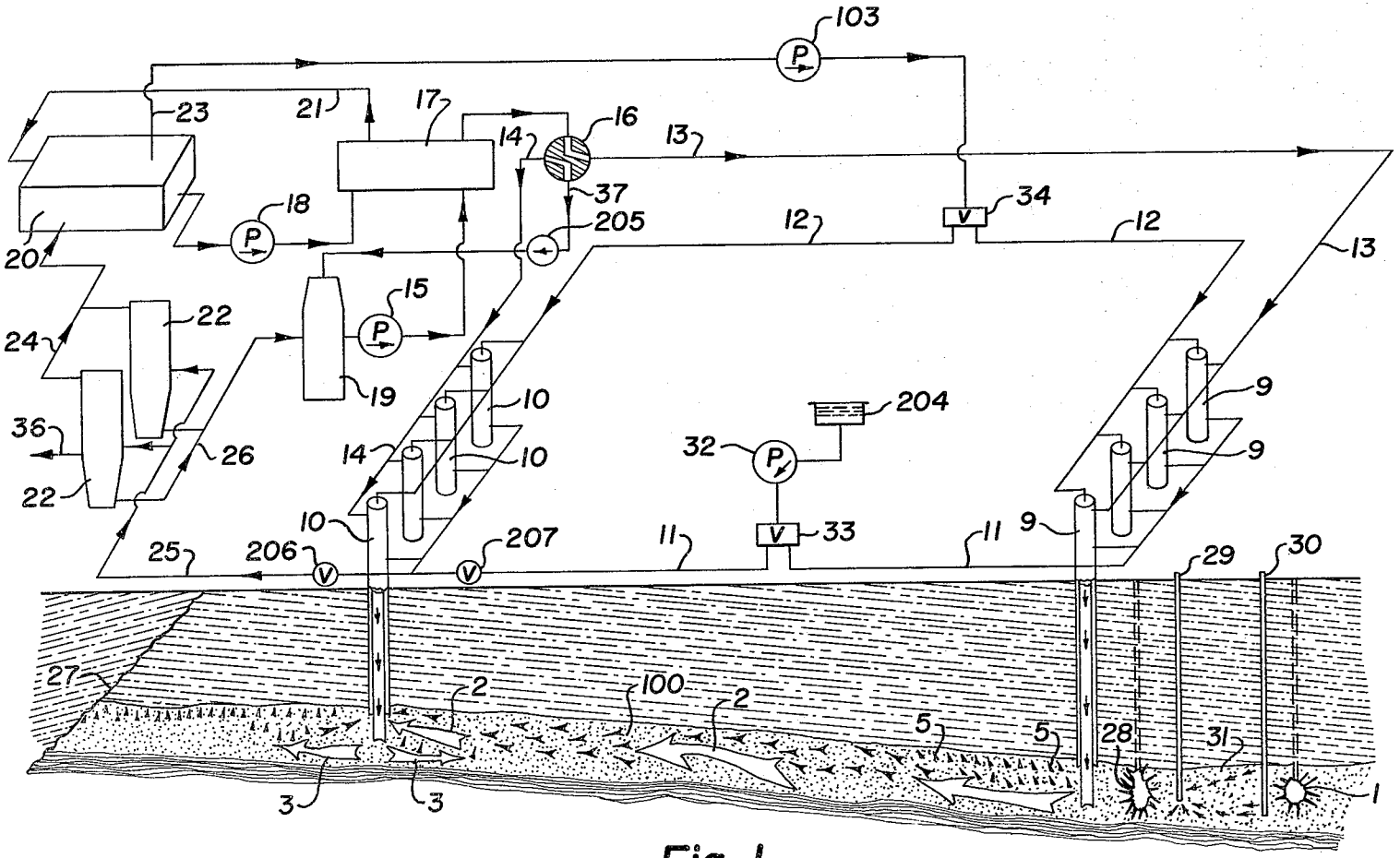

This invention relates to removal of gaseous, liquid and/or semiliquid hydrocarbons from subsurface deposits thereof. More particularly, it relates to methods and apparatus for isolating subsurface regions of fluid-permeable petroleum-bearing deposits and removing the gaseous, liquid and/or semi-liquid petroleum products entrapped therein.

Crude petroleum products in the form of gaseous, liquid and/or semiliquid hydrocarbons are typically found in stratified subterranean deposits. Such fields or pools of crude petroleum are generally represented by underground reservoirs of liquid, semiliquid and gaseous hydrocarbons accumulated in trap structures and can vary considerably with respect to reserve characteristics, geological environment and hydrodynamic conditions as well as other chemical and physical properties. Accordingly, most primary petroleum exploitation results in relatively low recovery factors which only in rare cases exceed 30% of the original oil-in-place reserves. The increasing scarcity of liquid hydrocarbons throughout the world has led, therefore, to secondary exploitation and then tertiary exploitation of previously abandoned or low-yield deposits.

Recent years have seen the emergence of a new field of mining engineering known as enhancement recovery engineering. Such enhanced recovery has already been credited with increasing recovery factors in some deposits to as high as 50%. In the United States alone combined primary and enhanced exploitation has resulted in the recovery of about 100 billion barrels of crude. However, over 400 billion barrels of crude reserves still remain in known deposits and continue to be classified as unminable or economically unrecoverable. A considerable part of these reserves can be recovered utilizing the principles of this invention.

Previously known enhanced methods of crude exploitation include cold and hot waterflooding; steam soaking and steam driving; cold and hot gas pressurizing (squeezing); and cold gas and wet chemical "softening". Application of these methods to enhance recovery from deposits with favorable geological conditions and light or moderately heavy crudes has led to an increase in recovery factors of up to 50%. However, for poorly permeable and heavy crude deposits recovery factors remain low, sometimes even as low as several percent, despite the application of enhanced methods; mainly because such prior enhanced recovery methods fail to develop dynamic crude migration and filtration processes over the entire deposit and surrounding area.

One of the problems frequently encountered in attempting enhanced recovery from petroleum deposits entrapped in some geological formations is the occurrence of water zones which are either segmented or surround the entire deposit. These zones are spatially non-isolated and are more permeable for the recovery media than for the crudes themselves. Because of this characteristic of some hydrocarbon deposits, any strong action of the injected medium, such as that caused by application of pressures in excess of those under which the deposit was formed in the geological process, can result in some loss of mobile crudes and dissipation of the accumulated hydrocarbons into the surrounding rocks. Indiscriminate use of waterflooding or steam driving has therefore led to loss of minable reserves and reduced recovery factors in some deposits, despite temporary increases in production.

Although engineering methods developed for crude reservoirs have been further refined, selective control of media flow in multi-lot, multi-ownership crude fields continues to be a problem. To protect property rights and prevent claims associated with stealing of reserves, priority has been given to those methods which conserve or only slightly intensify the original natural hydraulic conditions of liquid flow in spatially non-isolated crude oil reservoirs. To avoid potential ownership conflicts, such deposits are generally allowed to passively yield their crude through production wells. The enhanced recovery methods are therefore an attempt to facilitate such yielding or to prevent excessive drop of natural deposit pressure and, at most, to increase mobility of crude. In many cases, secondary enhanced recovery from deposits abandoned after improperly conducted primary operations does no more than restore original natural conditions. This allows crude to flow to production wells and results in recovery of some reserves originally present in the deposit; thus resulting in a static model of exploitation which permits recovery of 30% or slightly higher of the crude deposit.

The concept of non-dynamic crude exploitation processes is generally understood as that of regulating the flow of crudes to production wells based on the water:oil ratio. This means that any water breakthrough can determine production shutdown, despite the fact that the medium being discharged from the wells still contains crude. The objective is to equalize water-flooding which uniformly pushes crude toward production wells, even at the expense of negligible output. An example of a particularly static model of exploitation is one of polymer flooding methods which are intended to retard water filtration only to make the flooding more uniform and reduce the generation of water fingers by which water breaks through the pay zone to production wells. The prior methods of exploitation make no provisions for isolating the deposits being exploited from the surrounding permeable rock or for reducing their transmissivity and drainage ability. Instead, these methods focus on ways to increase pay zone permeability and thereby on differentiating filtration ability of peripheral and pay zones.

Because of the low effectiveness of the prior enhanced methods, economic escalation consists of several consecutive stages known as secondary, tertiary, etc., recovery. The characteristic feature of this approach is that production at any given stage, based on selected technology, can proceed from the moment at which the output shows definite improvement with respect to the preceding stage until this technology ceases to be economically effective. The decision to terminate such a recovery stage is determined not by some output limits set in advance, but by the reality of market and production economics. Thus, even marginal production effectiveness sufficient to exceed production costs can keep a given recovery stage operating over a period of many years, despite the existence of other methods which are economically more effective.

In some heavy hydrocarbon deposits, the extremely slow recovery of mobile components may be attributed to reliance on overburden pressure to force entrapped hydrocarbons from the formation instead of the more effective deposit hydraulic pressure. Recovery factors on such deposits are usually from several to up to 20% and have practically no chance of improvement. Heavy hydrocarbon fractions remaining in the deposit become trapped in compressed pores and fissures from which they cannot be recovered by any conventional enhanced techniques. Attempts to liquify and remove such heavy fractions have centered on thermal injection methods. However, typical thermal methods, such as interreservoir combustion of crudes, is limited only to increasing gas pressure in the cap zone and enhancing mobility of heavy crudes; utilizing to this effect both the temperature and chemical properties of the combustion gases. The combustion method, however, has many drawbacks, one of which is the difficulty in exercising full control over the combustion process in spatially non-isolated crude reservoirs.

The present invention provides an improved geotechnological hydrocarbon exploitation process wherein the entire deposit or a selected part of the deposit is effectively isolated and sealed from the surrounding earth strata by relatively thin substantially vertical underground screens and the trapped crude then flushed from the isolated deposit in a dynamic recovery process. The screens may serve a number of purposes including relative isolation of an area to be exploited to prevent fluids from flowing into or out of that area other than through the controlled wells being utilized in the exploitation process; support and uplift of the overburden to enhance porosity and permeability of the pay strata; control of the extent and direction in which the exploitation process takes place as well as control of process variables such as chemical composition, temperature, pressure and recirculation of fluids and gaseous injection media; and control of the effectiveness of the crude recovery process as well as its variables such as mobility, gravitational selectivity and differentiation. With an area of the deposit strata selectively isolated, a recovery media such as hot brine is circulated through the isolated zone. The recovery media is circulated through the pay zone under pulsating pressures so that the media is forced to flow turbulently through and expand the pores and fissures wherein the petroleum is entrapped, thus washing the petroleum from the pores rather than squeezing the pores as in previous methods. By isolating a region of the pay zone and recirculating a washing medium therethrough under increased pressures, the hydraulic pressure in the isolated region may be increased sufficiently to relieve the overburden pressure and the injected thermal energy may be retained in the isolated region. Thus, by recirculating the recovery medium through the isolated region, the viscosity of the trapped crude can be greatly reduced its mobility increased, and porosity of the deposit increased; thus recovery factors are vastly improved.

Figure 2:
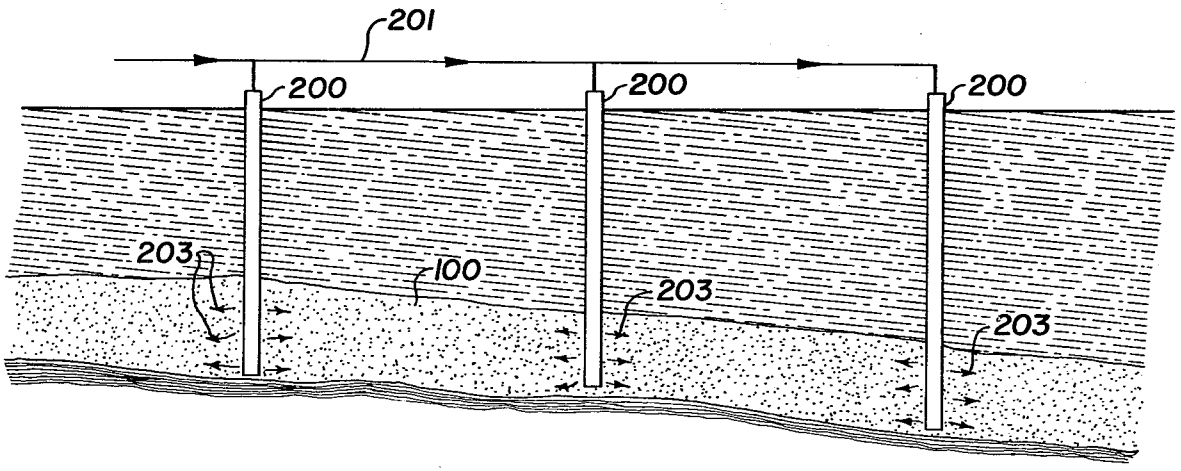

Other features and advantages of the invention will become more readily understood from the following detailed description taken in connection with the appended claims and attached drawings in which:

FIG. 1 is a schematic illustration of a hydrocarbon recovery system employing the principles of the invention; and FIG. 2 is a sectional view of an earth formation illustrating the preferred method for forming vertical screens in the production strata.

FIG. 1 illustrates one embodiment of the recovery system of the invention showing a vertical cross-sectional view of a stratified earth formation being exploited in accordance with the invention. The lower part of FIG. 1 is a vertical cross-sectional view of a sandy hydrocarbon deposit 100 showing the down-dip side view of a main screen 1 formed in accordance with the invention which not only isolates a selected region of the deposit 100 but also cooperates with a natural fault 27 in enclosing the entrapped reservoir of crudes from the up-dip side. Screen 1 may be formed by micropercussive hydraulic fracturing and sealing as will be described hereinafter and represents a continuous vertical barrier relatively impervious to fluid media. Thus, in cooperation with the fault 27, screen 1 isolates an enclosed deposit area.

In the deposit area 100 enclosed in part by main screen 1 and in part by natural fault 27, a flushing and carrying medium (indicated by thick arrows 2) is injected under high pressure through a line of injection wells 9. The medium 2 filters through the deposit 100 toward the up-dip or adjacent area, flushing on its way crudes entrapped in the deposit 100 and carrying them in a turbulent flow toward a line of production wells 10. As it flows, the stream of flushing and carrying medium 2 discharges flue gases and $CO_2$ (indicated in the drawing by small arrows 5) which have been previously dissolved in the medium. The gaseous component 5 is discharged both from the main flow of the flushing and carrying medium 2 and the auxillary circulatory flow 3 injected by wells 10. Both the main flow 2 and auxillary flow 3 help to increase hydraulic pressure present in the deposit 100 which in turn uplifts the overburden and increases permeability of the deposit. In the preferred embodiment, both streams are comprised of a heavy brine solution which, because of considerable difference in specific gravity with respect to liquid crudes, undergoes gravitational differentiation in the deposit and occupies the lower parts of the deposit 100; pushing the liquified crudes upwardly toward the earth surface. The brine/crude mixture or emulsion is spontaneously discharged through production wells 10 by the action of artesian pressure into the wellhead outlets and carried to separators 22 via manifold 25. In separators 22 the mixture is separated into the final product crude (received by manifold 36); gas (received by manifold 24) which may be utilized as a fuel in boilers 20; and brine (received by manifold 26) which is carried to tank 19. The brine is returned to recirculation by way of pump 15 via heat exchanger 17 and valve 16. Part of the brine is delivered to injection manifold 13 and wells 9 while another part is received by injection manifold 14 and transmitted to production-injection wells 10.

The valve 16 serves to produce a flow of flushing medium under pulsating pressures as will be described hereinafter. Relief line 37 connecting valve 16 with tank 19 receives relief flow from valve 16.

The main stream of brine 2 is periodically or steadily supplied with a mixture of water and gas recovered by the boiler flue gas recovery line 23. The mixture is passed through compressor 103 and, by means of control valve 34 and manifold 12, cyclically forced into either injection wells 9, production-injection wells 10, or both.

The upper left part of FIG. 1 illustrates a closed circulation heat exchange system consisting of pump 18, heat exchanger 17 and return manifold 21 through which fluid is carried back to boilers 20 for reheating.

The central part of FIG. 1 illustrates an injection pump 32 for injecting various chemical reagents capable of chemically activating the crude. The reagents are injected into the deposit 100 via wells 9 and 10 using control valve 33 and manifold 11.

In accordance with the invention underground vertical substantially fluid-impervious screens 1 are formed in the deposit to isolate a portion of the deposit from other portions of the deposit or to isolate the petroleum-bearing deposit from areas into which the crude petroleum could be lost. The screens may also be used to isolate the deposit from areas which are more pervious to the flushing medium than is the crude deposit; thus, unless effectively screened, the flushing medium would be lost and/or artificial pressure could not be maintained.

The underground vertical screens are preferrably formed by a hydraulic fracturing and sealing process in which the deposit strata is hydraulicly fractured in a vertical plane with a fluid which then petrifies and forms a substantially fluid-impervious wall.

As illustrated in more detail in FIG. 2 the screen 1 is formed by drilling a series of closely spaced boreholes in a line which conforms to the plane of the desired location of the screen. Since the screen-forming boreholes will not be used for any purpose other than forming the screen, they may be relatively small diameter boreholes but must penetrate the vertical plane of the strata in which the screen is to be formed. A fluid-impervious screen is then formed by hydraulicly fracturing the strata with a fluid which later solidifies and seals the formation.

As illustrated in FIG. 2, a plurality of boreholes are formed along a line defining the plane of the desired screen. Injection tubing is positioned on each well and sealed by conventional methods. Thus, a series of fracture wells 200 is formed which are connected with a hydraulic pump through injection line 201.

In the preferred method of forming the screen 1, the deposit 100 is fractured by micropercussive fracturing wherein a fluid is injected into the formation in repetitive pressure pulses. Accordingly, the fracturing occurs in an expanding radius (indicated by arrows 203) from each fracturing well 200 until the fracturing is interconnected by overlapping. Therefore, the horizontal spacing of the fracturing wells will depend on many variables such as the depth and thickness of the producing strata, the composition of the strata, the water content of the strata, the pressure to be used in fracturing, etc. These variables, however, can be computed with known technology and must be determined individually for each reservoir. Generally, however, it will be recognized that where the deposit is relatively shallow, excessive fracturing pressures cannot be used and the boreholes will thus be more closely spaced. With deeper formations, larger fracture well spacings may be used. Likewise, the pressure used as well as the pulse rate of pressure applied will be determined by the same factors. In any event, the formation is simultaneously fractured in each of the wells 200 by repetitive pulses of pressure (as will be described in further detail hereinafter) until the fractured areas overlap forming a substantially vertical plane of fractured strata of finite thickness.

While the fracturing process employed is similar to conventional fracturing processes, the process described herein is a radical departure from conventional oil well fracturing in two major respects. In conventional fracturing, the formation is fractured to increase porosity of the formation and permit fluid to flow to the fracturing well after the fracturing process is completed.

Furthermore, since conventional fracturing is designed as an aid to promote water and oil flow to a water flood recovery well, fracturing in a plane to connect two or more wells would obviously be detrimental since the water would flow directly along the fractured plane and not flood the formation.

In the present invention, not only is the fractured area overlapped to form a fractured plane, but the fracturing fluid is expressly designed to solidify and render the fractured plane substantially fluid-impervious. Accordingly, the fracturing medium used in forming the screens is a fluid which, after the fracturing is completed, expands in the fractured pores and solidifies, rendering the fractured area substantially fluid-impervious.

Various fluids which have these desired characteristics may be used. For example, a chemically stabilized water suspension of clayly materials may be used. Typically such clay materials may comprise:

Montmorillonite: 5–10% by weight
Kaolinite and Illite: 50–70% by weight
Calcium Carbonate: 5–10% by weight
Silica: 1–10% by weight
Organic Materials: 1–5% by weight Such clayly suspensions may be readily formed and used as a hydraulic medium for fracturing and, when used with a petrifier such as polyacrylamide, are ticsotropic and expand and solidify in the fracture. Thus, by varying the composition of the clayly material and the petrifier, solidification of the ticsotropic medium can be timed to occur immediately after overlapped fracturing has occurred.

By employing a micropercussive fracturing process wherein the fracturing medium is injected in pressure pulses simultaneously in each of the fracturing wells 200, the fracturing process can be directed along the vertical plane of the line of fracturing wells. In some cases the micropercussive fracturing process may be aided by detonation of microexplosive charges positioned in the fracturing wells. For example, when the fracturing well passes through a natural cleavage or the like, it may be necessary to seal the cleavage by detonation of an explosive charge therein. By using both micropercussive fracturing and microexplosive detonation, the fracture plane can be closely controlled and directed to form the desired sealing screen 1. Repeated overlapping of mechanical and hydraulic effects of these two operations results in the formation of a vertical fissure along the main vector of forces, i.e., along the plane of the closely spaced boreholes. The imperviousness of the screen and its mechanical resistance to possible hydraulic puncturing can be controlled within a wide range. The screen can be made to withstand considerable pressure differentials (on the order of 1000 psi and higher) between the enclosed area of the deposit and the area lying outside the enclosure. These pressures are sufficiently high to fulfill all the objectives of the recovery method disclosed.

In both micropercussive hydraulic fracturing and microexplosive detonation fracturing attempt is made to obtain the narrowest but longest possible vertical fractures, irrespective of the depth at which the screen is to be constructed. Prior art fracturing performed to increase overburden permeability has shown that fracturing in shallow formations tends to produce horizontal fractures which become progressively more vertical as the depth of these formations increases. The tendency of the deposit rock to split in an undesired direction can be also attributed to tectonic cleavage. To avoid these obstacles, repeated pulsatory overlapping of the micropercussive hydraulic fracturing effect supported by repeated microexplosive fracturing may be applied.

The purpose of microexplosive fracturing is to avert natural cleavage-direction fracturing. However, the tendency of the rock to fracture in the direction of cleavage can frequently be beneficial, particularly when the general direction of cleavage coincides with the desired orientation of the screen. In such cases, microexplosive operations are used only on beds deposited closely to the surface in which vertical column-type explosive charges make it possible to create vertical chimney-type caves from which, using micropercussive hydraulic fracturing and sealing, a vertical screen can be developed.

In the typical recovery operation illustrated in FIG. 1, a series of injection wells 9 are positioned in close proximity to the screen 1 and penetrate the isolated area of deposit 100. A series of production wells 10 are aligned adjacent the opposite side of the isolated deposit 100. Accordingly, the injected flushing and carrying medium flows generally in the direction from the injection wells 9 toward the production wells 10 as indicated by arrows 2.

In the preferred embodiment of the invention the flushing and carrying medium 2 is a heated brine solution which is injected through injection wells 9 under pulsating pressures and also injected into the deposit 100 through the production wells 10 to form an auxillary flushing stream indicated by arrows 3.

Apparatus for applying alternating pulsating current to injection wells 9 and production wells 10 is schematically illustrated in FIG. 1. As illustrated in FIG. 1 the flushing and carrying medium 2 to be injected into the wells 9 and 10 is drawn from tank 19 by pump 15. Distribution of the fluid is controlled by valve 16 which may be a four-way ball-type valve as illustrated wherein the output from pump 15 is alternately injected into manifolds 13 and 14 which feed injection wells 9 and production wells 10, respectively. It will be observed that when fluid under pressure from pump 15 is injected into manifold 13 the fluid under pressure in manifold 14 is vented to relief line 37. As the valve rotates fluid under pressure is injected into manifold 14 and manifold 13 is vented to relief line 37. It will thus be observed that as the valve is rotated pressure pulses are alternatively fed into injection wells 9 and production wells 10. When a pressure pulse is applied to one manifold the other mainfold is vented to the tank 19. The frequency of the pressure pulses is thus controlled by the speed of rotation of valve 16. The pressure differential of the pressure pulses is controlled by the difference in pressure supplied by pump 15 and the relief pressure setting of relief valve 205. Therefore, the relief valve 205 may be set at a minimum field pressure so that each pulse of pressure from the pump 15 supplies a ramming action into the wells which are thereafter vented to a minimum field pressure. The minimum field pressure may, of course, be set as desired by variation of the relief vent pressure of relief valve 205. By supplying pressure pulses alternatively to injection wells 9 and production wells 10, the flushing and carrying medium may be injected into the deposit 100 and forced therethrough in a series of pressure pulses.

It should be noted that in the production wells 10 the flushing and carrying medium is injected through the central tube at the lower strata of the deposit 100. When sufficient pressure has been developed in the deposit 100 to cause artesian type flow, the flushing medium is carried to the wellhead through the outer tubing of the production wells 10 which have their inlet openings at the upper portion of the producing strata. Because of the difference in specific gravity of liquid petroleum and brine, the brine/oil emulsion undergoes differentiation in the strata 100 causing the liquid petroleum to rise to the top of the deposit 100. Thus the fluid delivered to the production wells 10 will have the highest content of recovered crude. Furthermore, since the flushing medium is injected at the lower strata and the recovered fluid withdrawn at the top of the strata, fluid can be continuously injected and simultaneously continuously withdrawn.

It should be observed that since the portion of the producing strata 100 isolated by a fault 27 and screen 1 is totally confined, the hydraulic pressure therein may be increased substantially above the naturally-occurring pressure. Thus the pressure in the producing strata 100 may be increased sufficiently, particularly in shallow deposits, to relieve the overburden pressure and thus release heavy crudes entrapped in collapsed pore structures. Furthermore, because the hydraulic pressure can be dramatically increased, the flushing medium is forced through the pores under relatively high pressures; resulting in a turbulent flow through the pores and fissures. Accordingly, the entrapped hydrocarbon deposit is washed from the pores in a turbulent flow action rather than squeezed from the pores as in conventional recovery processes. Thus the dynamic recovery system of the invention is a radical departure from conventional recovery systems since the recovery process is a dynamic process wherein a fluid medium is flushed through the pay strata under relatively high pressure and the entrapped deposit is washed from the pores rather than squeezed from the pores. Therefore, essentially all of the entrapped hydrocarbon deposit may be eventually washed from the pay strata.

To increase mobility and decrease viscosity of the entrapped deposit, the flushing medium may be heated. Injection of heated flushing medium, such as brine or the like, raises the temperature of the entire deposit 100 and thus decreases viscosity of the crudes. Since the brine is continuously recirculated through the isolated pay strata, the overall temperature of the pay strata may eventually be increased without significant thermal losses to the surrounding area. Thus the temperature of the entire pay zone may eventually be raised to much higher temperatures than can be achieved with conventional processes; while the cost of thermal injection is reduced by eliminating thermal loss to surrounding formations.

To further enhance mobility and reduce viscosity of the crude petroleum, various conventional chemical reagents may be injected into the deposit 100 via wells 9 and 10. For example, chemicals capable of activating the crude may be withdrawn from chemical tank 204 by pump 32 and injected into manifold 11 by distribution valve 33. These chemicals may be injected into wells 9 continuously or intermittently as desired by injecting them directly into the brine solution or into the upper portion of the pay strata through the outer tube of wells 9 and 10. The chemicals may be injected continuously or intermittently into the brine stream injected through the inner tubing of wells 10 or, if desired, valve 206 may be closed when valve 207 is open and the chemicals back-flushed into the top of the pay strata through the outer tubing of production wells 10.

It will be observed that the hydraulic ramming action used in the recovery process wherein a hydraulic medium is forced into the pay strata in pressure pulses is very similar to the process employed in forming the screen 1 described hereinabove. However, in forming the screens the hydraulic fluid is designed to solidify and seal the fractured strata. In the recovery process, the hydraulic fluid is a flushing or washing medium, preferrably superheated brine. However, the pressure pulses may be sufficient to cause micropercussive fracturing in the recovery process as well, thereby eventually fracturing the entire trapped deposit 100 to release the hydrocarbons entrapped therein.

As described above, flue gases and $CO_2$ or other gases may be dissolved in the brine to further enhance crude mobility. As indicated by the small arrows 5 in FIG. 1, the dissolved gases may separate from the liquid and penetrate the pay zone to heat and activate heavy crudes trapped in the formation. The dissolved gases tend to migrate upwardly and open the pores to aid in flushing the petroleum from the trapped deposit.

It should be particularly noted that the recovery system of the invention is a dynamic system wherein the deposit 100 is effectively sealed from surrounding earth strata and the hydraulic pressure in the deposit raised substantially above normally-occurring pressure. Furthermore, the recovery medium is continuously recirculated through the pay zone to wash essentially all the entrapped hydrocarbons therefrom rather than pushing the crude with a recovery medium as in conventional waterflooding. Accordingly, the recovery medium may be recirculated through the isolated deposit until essentially all the entrapped crude is recovered. By circulating the recovery medium through the pay zone under high pressure, the fluid medium is forced to flow through the pore structure in a turbulent flow, thus washing the crudes from the pores while relieving the overburden pressure to open the pores.

Turbulent flow of brine is used to flush the deposit rather the flood it, therefore the crude fractions are washed out rather than squeezed out. The turbulent flow permits guiding turbulent streams in specific directions rather than permitting them to sweep over a wide area causing dispersal of volume and temperature. Therefore, the process of the invention permits recirculating large quantities of brine, rather than wastefully disposing of them.

Because of the considerable outflow of water from production wells, high water:oil ratio in this method does not necessarily mean a breakthrough to production wells or a production shutdown as it did in the past. In the method of this invention, flushing medium is introduced into the deposit via injection wells ordinarily drilled for this purpose. These low-cost, small-diameter wells are spaced at close intervals along well-defined elongated belts which liquids can flow linearly rather than radially.

For secondary recovery or subsequent operations, injection wells can be arranged in such a way that a linear type of flow either perpendicular or oblique with respect to the historically induced direction of the flow of liquids that had occurred in previous exploitation or during migration of geological reserves can be induced in the deposit. The resultant crossflow enhances the effectiveness of flushing. Hence, only in rare cases is it necessary to arrange the injection wells along the line consistently perpendicular to the direction of the pay zone dip. Within the area enclosed by the screen, the direction of natural waterflooding from the surrounding aquafier can be practically desregarded and the area can be treated as an isolated unit.

The brine is injected under high pressure into the deposit strata enclosed by the screen with the latter playing a role in supporting that pressure. When applying high pressure, formation and elevation of the pay zone base are of secondary importance. The important factors in determining effectiveness of the recovery process are high penetrability and transportability of crude as it is subjected to turbulent flow of the flushing medium.

The screen isolation of the pay zone can lead to high gravitational diffenentiation of liquids in the deposit. Thus, use of brine (which has a higher specific gravity than oil) is particularly helpful. Hence, regardless of the direction of flushing, segregation of liquids can be carefully controlled.

As described hereinabove, flue gases and the like may be dissolved in the flushing medium to aid in liquifaction of heavy crudes and to also inject thermal energy into the pay zone. The hot gases may also be injected alternatively with the liquid medium by simply substituting injected hot gases for injected hot brine. The hot gas and hot brine injection may also be effected simultaneously. Furthermore, utilizing the screening process hereinabove described, a portion of the pay zone may be isolated by additional screens and the hydrocarbons entrapped therein burned in place to form hot gas for injection into the pay zone undergoing direct recovery. As illustrated in the lower right-hand portion of FIG. 1, an intermediate screen 28 may be formed between the main screen 1 and the injection wells 9 to isolate a smaller portion 31 of the deposit 100. Intermediate screen 28 is formed by the same process as described with respect to screen 1 and cooperates with screen 1 to isolate a small portion 31 of the deposit 100.

Hydrocarbons in the portion 31 of deposit 100 isolated by intermediate screen 28 are converted to gas by in situ gassification. In situ gassification can be performed by injecting controlled amounts of oxygen and steam into the gassification zone 31 through injection well 30. The synthetic gas produced may be recovered by gas recovery well 29 and injected into the pay zone 100 through wells 9. Alternately, screen 28 may be a segmented screen which permits the synthetic gas to escape zone 31 directly into zone 100. If desired, the screen 28 may be formed with vertical segments which permit the gas to escape therebetween. Alternatively, barrier screen 28 may extend vertically less than the thickness of the deposit 100, thereby permitting the synthetic gas to escape into the zone being exploited either under or over the screen 28. Accordingly, the synthetic gas may be directed into either the top of the pay zone or the bottom of the pay zone as desired. By totally isolating the gassification zone 31, variables such as temperature, deposit pressure and water content of the area undergoing gassification can be closely controlled. Since variables such as chemical composition and heat value of the produced synthetic gas can be closely controlled by constructing underground screens, enclosed area 31 of the deposit is converted into an underground retort. The synthetic reaction product, i.e., gas, may also be used as by-product fuel for heating the brine in the continued exploitation of liquid hydrocarbons or can be sold as an end market product.

The underground synthesis of gas is caused by igniting the crude in the deposit 31 and by continuous feeding of the burning hydrocarbons with stoichiometrically measured quantities of oxygen and water. Synthetic gas can be extracted directly from special wells or indirectly from liquid crude production wells after its passage through the zone of active exploitation of liquid hydrocarbons.

To make production of synthetic gas independent of technological factors present in the zone of active production of liquid crude, segments of relatively impervious screen which divide the field into smaller blocks may be formed in the deposit. Water influx, high water pressure and other unwanted intrusions from the surrounding parts of deposit can be effectively controlled or reduced to manageable levels within these blocks. The filtration of synthetic gas through the liquid crude production area will facilitate this production, primarily due to the liquifying ability (surfactant activity) of both synthetic medium and unreacted $CO_2$. Furthermore, after the removal of all liquifiable hydrocarbon from the deposit 100, the remaining immobile hydrocarbons may be removed from the entire deposit by the same gassification process. Accordingly, in accordance with the teachings of this invention, geotechnological preparation of the deposit 100, hydrodynamic flushing of crudes, optional chemical processes and synthetic gassification are applied almost simultaneously and the cummulative effect of these processes may lead to the attainment of recovery factors as high as 90% in one complex technological process rather than in several consecutive states. Hence, the method of this invention makes it possible to increase output, raise recovery factors, reduce chemical degradation of hydrocarbons and improve production economics.

From the foregoing it will be observed that the use of variable pressure pulsing of the recovery medium through the pay zone in accordance with the invention results in a turbulent flow which flushes the crudes from the deposit. Furthermore, this process results in uplifting of the overburden and opening of rock pores by the action of hydraulic pressure, as opposed to contraction of reservoir and decompression and compaction of pores and fissures as occurs when crude is removed in conventional processes. Intensive flow of the liquid media from the injection points to drainage points enhances mobility of crude and of brine and permits artesian discharge in production wells.

The pulsed pressure injection also results in multidirectional microfracturing. Increase in permeability and mobility of crudes within the microfractured deposit with high pressure recirculation of fluids is further enhanced by preheating the brine to temperatures of 300°-350° F. or higher and by heating flue gases to temperatures of 350°-400° F. The chemical and physical properties of brine, such as the ability to stabilize clay minerals and control their tendency to swell, can also be instrumental in increasing deposit permeability. Furthermore, the effects of the various chemical and physical processes, such as dissolution, diminishing of interfacial tension, decreasing viscosity and increasing mobility of fluids, etc., will be considerably magnified because of the intensification of these processes under conditions created in the deposit area enclosed and separated from the remainder of the formation by the underground sceen. The use of heated recovery medium alone results in about a ten-fold change in hydrocarbon viscosity and a seven-fold change in water viscosity. The heated fluid further assists in melting heavy fractions that obstruct the flow of technological media in a porous rock and also causes an increase in the gravitational differentiation between water and crude; allowing a separation of these two elements to be made directly in the deposit. Injecting thermal energy into the formation causes thermal expansion of the rock which leads to secondary fracturing and enhanced filtration and also causes a reduction of the interfacial tensions; facilitating formation of crude emulsion.

Temperature selection for the flushing medium is partially determined by hydrocarbon composition and projected production goals, type of pay rock and economic considerations. Application of excessively high temperatures contributes to higher costs of operation and is not always desirable because of crude degradation. Use of brine as the flushing medium aids in increasing gravitational differentiation between hydrocarbon products and the flushing medium and prevents boiler scaling and dissolution of limestone by the recirculating water. The salt further controls swelling of clay fractions in the pay zone which impede filtration. Use of brine also creates the possibility of forming salt screens in the cooler peripheral parts of the deposit to reduce seepage of hot brine and increases kinetic energy of the stream used for flushing the crude from the deposit.

While the invention has been described with particular reference to specific screen-forming techniques and flushing media, it will be understood that the forms of the invention shown and described in detail are to be taken as preferred embodiments of same; and that various changes and modifications may be resorted to without departing from the spirit and scope of the invention as defined by the appended claims.

What is claimed:

1. The method of recovering liquifiable hydrocarbons from a fluid-permeable subterranean zone containing entrapped deposits thereof comprising the steps of:
   (a) forming a substantially fluid-impervious vertically extending screen to isolate said fluid-permeable subterranean zone from other fluid-permeable subterranean zones by
      (i) forming a plurality of boreholes extending from the earth surface into said fluid-permeable subterranean zone aligned substantially along the desired vertical plane of said screen;
      (ii) fracturing the subterranean zone between said boreholes; and
      (iii) sealing the fractured zone by injecting sealing medium into said fractured zone; and
   (b) flushing a fluid medium through the isolated subterranean zone.

2. The method set forth in claim 1 wherein the hydraulic pressure in said isolated subterranean zone is increased to a greater pressure than the naturally-occurring pressure therein.

3. The method set forth in claim 1 wherein said fluid medium is heated.

4. The method set forth in claim 1 wherein said fluid medium is injected into said isolated subterranean zone in a series of pressure pulses.

5. The method set forth in claim 1 wherein said fluid medium is brine.

6. The method set forth in claim 1 wherein said fluid medium is hot gas.

7. The method set forth in claim 1 wherein said fluid medium is alternately brine and hot gas.

8. The method set forth in claim 5 wherein said brine contains dissolved gas.

9. The method set forth in claim 1 wherein said fractured zone is formed by injecting a fracturing fluid into said boreholes in a series of pressure pulses.

10. The method set forth in claim 9 wherein said fracturing fluid is a material which solidifies and seals the fractured portion of said subterranean zone.

11. The method of forming a substantially fluid-impervious screen in a subterranean hydrocarbon deposit comprising the steps of (a) forming a plurality of boreholes extending from the earth surface into said subterranean deposit along the desired vertical plane of said screen;

(b) injecting a fluid medium into a plurality of said boreholes simultaneously in a series of pressure pulses under sufficient pressure to fracture the region of said deposit between said boreholes, thereby forming a substantially vertical zone of fractured deposit extending along said desired vertical plane; and (c) injecting a sealing medium into said vertical zone of fractured deposit which solidifies to form a substantially fluid-impervious barrier.

12. The method set forth in claim 11 including the step of detonating microexplosive charges in said boreholes to aid in fracturing said deposit.

13. The method set forth in claim 1 wherein the sealing medium is used as the fluid medium injected into said boreholes in a series of pressure pulses and said microexplosive charges are detonated between pressure pulses.

14. The method set forth in claim 11 wherein the sealing medium is used as the fluid medium injected into said borehole in a series of pressure pulses.

15. A system for removing liquifiable hydrocarbons from a fluid-permeable subterranean deposit thereof comprising (a) substantially fluid-impervious vertical barrier means defining an enclosed fluid-permeable subterranean deposit of liquifiable hydrocarbons;

(b) first means for injecting a substantially liquid medium into said enclosed subterranean deposit;

(c) means for injecting a fluid medium into said first means in a series of pressure pulses;

(d) second means for withdrawing fluid containing said liquid medium from said subterranean deposit, said first means being spatially removed from said second means whereby fluid injected through said first means must horizontally traverse a substantial portion of said enclosed subterranean deposit to be withdrawn from said second means; and (e) means for separating hydrocarbons from said liquid medium withdrawn from said second means and recirculating said liquid medium through said enclosed subterranean deposit.

16. The system defined by claim 15 wherein said second means is a plurality of production wells having an injection tube for injecting said substantially liquid medium into the lower strata of said subterranean deposit while simultaneously withdrawing fluid from the upper strata of said deposit.

17. The system defined by claim 15 including means for heating said substantially liquid medium.

18. The system defined by claim 15 including means for injecting hot gases into said fluid medium.

19. The system defined by claim 18 including boiler means for heating said fluid medium and means for collecting flue gases from said boiler means and injecting said flue gases into said fluid medium.

20. The method of recovering liquifiable hydrocarbons from a fluid-permeable subterranean zone containing entrapped deposits thereof comprising the steps of:

(a) forming a substantially fluid-impervious vertically extending screen to isolate said fluid-permeable subterranean zone from other fluid-permeable subterranean zones by (i) forming a plurality of boreholes extending from the earth surface into said fluid-permeable subterranean zone substantially aligned along the desired vertical plane of said screen;

(ii) fracturing the subterranean zone between said boreholes; and (iii) sealing the fractured zone by injecting sealing medium into said fractured zone;

(b) forming a plurality of injection wells for injecting a fluid medium into the isolated subterranean zone;

(c) forming a plurality of production wells for withdrawing fluid from said isolated subterranean zone, said production wells being horizontally removed from said injection wells; and (d) alternately injecting a fluid medium into said production wells and said injection wells in a series of pressure pulses and simultaneously continuously withdrawing fluid from said production wells.

21. The method set forth in claim 20 wherein said production wells include an injection tube extending to the lower strata of said isolated subterranean zone whereby said fluid medium is injected into the lower strata of said zone in a series of pressure pulses through said injection tube while fluid is continuously withdrawn from the top of said zone through said production wells.

22. The method set forth in claim 20 wherein said production wells are vented to substantially atmospheric pressure when said pressure pulses are applied to said injection wells and said injection wells are vented to substantially atmospheric pressure when said pressure pulses are applied to said injection wells.

23. Apparatus for removing liquifiable hydrocarbons from a fluid-permeable subterranean deposit thereof comprising:

(a) substantially vertical and substantially fluid-impervious barrier screen means isolating said subterranean deposit from other fluid-permeable earth formations;

(b) at least one injection well for injecting a fluid medium into the isolated subterranean deposit;

(c) at least one production well for withdrawing fluid from said isolated subterranean deposit, said production well including an injection tube for injecting fluid medium into said isolated subterranean deposit and a production tube for simultaneously withdrawing fluid from said subterranean deposit; and (d) means for injecting a fluid medium into said injection well with sufficient pressure to cause said fluid medium to flow turbulently through the pore formations in said isolated subterranean deposit;

wherein said means for injecting a fluid medium into said injection well comprises a pump, a distribution valve and a storage tank with said pump adapted to withdraw fluid from said storage tank and supply fluid under pressure to said distribution valve and said distribution valve is adapted to alternately direct said fluid under pressure into said injection tube in said production well while venting said injection well to said storage tank and direct said fluid under pressure into said injection well while venting said injection tube in said production well to said storage tank; thereby alternately supplying fluid under pressure to said injection well and said production well.

24. Apparatus as defined in claim 23 including means for maintaining a predetermined minimum pressure on said fluid in said injection tube and said injection well when each is vented to said storage tank.

25. Apparatus as defined in claim 23 including means for separating liquid hydrocarbons and gaseous products from said fluid medium withdrawn from said production well and returning said liquid medium to said storage tank whereby said liquid medium may be continuously recirculated through said subterranean deposit.

26. Apparatus as defined in claim 23 including means for heating said fluid medium.

* * * * *

UNITED STATES PATENT AND TRADEMARK OFFICE

CERTIFICATE OF CORRECTION

PATENT NO. : 4,305,463

DATED : December 15, 1981

INVENTOR(S) : BOHDAN ZAKIEWICZ

It is certified that error appears in the above–identified patent and that said Letters Patent are hereby corrected as shown below:

On the Title Page, line 6, "Filed: Oct. 31, 1970" should read ---Filed: Oct. 31, 1979---

In Column 2, line 17, "crude" should read ---crudes---

In Column 3, line 51, "reduced its" should read ---reduced, its---

In Column 9, line 56, "belts which" should read ---belts in which---

In Column 13, line 28, "claim 1" should read ---claim 12---

In Column 5, line 28, "are" should read ---is---

In Column 7, line 16, "are" should read ---is---

In Column 7, line 18, "are" should read ---is---

Signed and Sealed this

*Twenty-third* Day of *March 1982*

[SEAL]

*Attest:*

GERALD J. MOSSINGHOFF

*Attesting Officer*

*Commissioner of Patents and Trademarks*